US010478976B2

(12) United States Patent
Liang et al.

(10) Patent No.: US 10,478,976 B2
(45) Date of Patent: Nov. 19, 2019

(54) HANDLE AND KNIFE HAVING THE SAME

(71) Applicants: Nextorch Industries Co., Ltd., Guangdong (CN); Power Source Industries Co., Ltd., Guangdong (CN)

(72) Inventors: Houkun Liang, Guangdong (CN); Bing Liang, Guangdong (CN)

(73) Assignees: NEXTORCH INDUSTRIES CO., LTD., Guangdong (CN); POWER SOURCE INDUSTRIES CO., LTD., Guangdong (CN)

( * ) Notice: Subject to any disclaimer, the term of this patent is extended or adjusted under 35 U.S.C. 154(b) by 95 days.

(21) Appl. No.: 15/588,989

(22) Filed: May 8, 2017

(65) Prior Publication Data

US 2017/0348862 A1 Dec. 7, 2017

(30) Foreign Application Priority Data

Jun. 7, 2016 (CN) ..... 2016 2 0555873 U

(51) Int. Cl.

| | |
|---|---|
| ***B26B 1/10*** | (2006.01) |
| ***A45F 5/02*** | (2006.01) |
| ***B26B 1/02*** | (2006.01) |

(52) U.S. Cl.

CPC ..... *B26B 1/10* (2013.01); *A45F 5/02* (2013.01); *B26B 1/02* (2013.01); *A45F 2200/0566* (2013.01); *A45F 2200/0575* (2013.01)

(58) Field of Classification Search

CPC ..... Y10T 24/1391; Y10T 24/1394; Y10T 24/1347; Y10T 24/1324; A45F 5/021; A45F 5/02; B43K 25/02; B43K 25/022; B43K 25/024; B43K 25/026; B43K 25/028; B43K 24/04; B43K 23/126

USPC ..... 30/198, 298.4, 162, 155, 320, 335, 151; 224/269, 232, 668, 669; 401/106; 16/427

See application file for complete search history.

(56) References Cited

U.S. PATENT DOCUMENTS

| | | | | |
|---|---|---|---|---|
| 1,490,231 A * | 4/1924 | Poole | B43K 25/022 | 24/11 M |
| 1,720,471 A * | 7/1929 | Rockel | B43K 25/022 | 24/11 S |
| 1,725,064 A * | 8/1929 | Easton | B43K 25/022 | 24/326 |
| 2,075,932 A * | 4/1937 | Ehrmann | B43K 25/026 | 132/73.5 |

(Continued)

*Primary Examiner* — Laura M Lee

(74) *Attorney, Agent, or Firm* — Knobbe, Martens, Olson & Bear, LLP

(57) ABSTRACT

Disclosed embodiments relate to a handle and a knife. In some embodiments, the handle includes: a handle body, a locating portion is provided on the handle body; and a handle clamp, the handle clamp including a first clamping arm, a second clamping arm and a connecting portion, the connecting portion is provided between the first clamping arm and the second clamping arm, and the first clamping arm is movably provided on the handle body and enables the handle clamp with a retraction position and an extension position. Some embodiments solve the problems in the prior art that a handle is prone to slide off from a pocket due to a bad fit between the handle and the pocket and the handle is not prone to be hidden in the pocket when the handle is clamped in the pocket.

16 Claims, 3 Drawing Sheets

(56) References Cited

U.S. PATENT DOCUMENTS 3,453,694 A * 7/1969 Emil ..... B43K 25/02 24/11 F
4,365,390 A * 12/1982 Kageyama ..... B43K 25/024 24/11 F
4,551,035 A * 11/1985 Baker ..... B43K 25/028 401/104
4,608,733 A * 9/1986 Eylers ..... B43K 23/126 24/11 F
4,797,982 A * 1/1989 Eylers ..... B43K 25/02 24/11 CC
4,856,192 A * 8/1989 Collins ..... B26B 29/025 30/151
4,903,375 A * 2/1990 DiFranco ..... A45F 5/02 24/3.12
5,061,105 A * 10/1991 Isoda ..... B43K 23/124 401/202
5,537,724 A * 7/1996 Chou ..... A44B 6/00 132/145
5,632,564 A * 5/1997 Chu ..... B43K 25/02 401/104
5,632,565 A * 5/1997 Yamaguchi ..... B43K 23/124 24/11 F
6,015,077 A * 1/2000 Disher ..... A45B 25/24 135/34.2
6,519,813 B1 * 2/2003 Lin ..... B43K 25/02 24/11 F
7,815,081 B2 * 10/2010 Gist ..... A45F 5/02 224/268
8,001,693 B2 * 8/2011 Onion ..... B26B 1/02 30/155
8,028,873 B2 * 10/2011 Hawk ..... A45F 5/022 224/269
8,112,894 B2 * 2/2012 Caswell ..... A45F 5/02 224/269
8,783,141 B2 * 7/2014 Caswell ..... A45F 5/02 224/269
8,875,405 B2 * 11/2014 Trees ..... A61B 17/3211 30/151
9,370,282 B1 * 6/2016 Petersen ..... A47K 7/028
9,643,266 B1 * 5/2017 Hooyman ..... B23D 51/01
2004/0117933 A1 * 6/2004 Tubman ..... A46B 5/00 15/160

* cited by examiner

HANDLE AND KNIFE HAVING THE SAME

CROSS REFERENCE TO RELATED APPLICATIONS

This application claims the benefit of Chinese Patent Application No. 201620555873.3, filed on Jun. 7, 2016, entitled "Handle and knife having the same", which is hereby incorporated by reference in its entirety.

TECHNICAL FIELD

The present disclosure relates to the technical field of hardware knives, and more particularly to a handle and a knife including the same.

BACKGROUND

A handle clamp of a folding knife in the prior art is fixedly installed on a handle. When the folding knife needs to be put into a pocket, the handle clamp having the foregoing structure will be prone to slide off from the pocket due to a bad fit between the handle clamp and the pocket, and the knife with the foregoing structure is not prone to be hidden in the pocket.

SUMMARY

The present utility model mainly aims to provide a handle and a knife having the same, intended to solve the problems in the conventional art that a handle is prone to slide off from a pocket due to a bad fit between the handle and the pocket and the handle is not prone to be hidden in the pocket when the handle is clamped in the pocket.

To this end, according to some embodiments of the present disclosure, a handle is provided, which comprises: a handle body, a locating portion is provided on the handle body; and a handle clamp, the handle clamp comprising a first clamping arm, a second clamping arm and a connecting portion, the connecting portion is provided between the first clamping arm and the second clamping arm, and the first clamping arm is movably provided on the handle body and enabling the handle clamp with a retraction position and an extension position.

Further, a first fitting portion and a second fitting portion are provided on the first clamping arm, the first fitting portion is close to the connecting portion relative to the second fitting portion, when the first fitting portion matches with the locating portion, the handle clamp is located at the retraction position, and when the second fitting portion matches with the locating portion, the handle clamp is located at the extension position.

Further, the handle body comprises a first side plate and a second side plate, opposite to each other. The first side plate is provided with an avoidance channel running through an internal surface of the first side plate and an external surface of the first side plate, the locating portion is provided in the avoidance channel, the locating portion comprises a cantilever and a bulge provided on the cantilever, the bulge protruding inwardly, the first clamping arm penetrates through the first side plate and the second side plate, and the bulge abuts against the first clamping arm.

Further, the avoidance channel is provided at a first end of the first side plate, a first end of the cantilever is connected with an inner wall, away from the first end of the first side plate, of the avoidance channel, and a clearance is provided between a second end of the cantilever and an inner wall, close to the first end of the first side plate, of the avoidance channel.

Further, a first end of the second side plate includes an avoidance gap in order that the handle clamp cannot protrude out of the first end of the first side plate when the handle clamp is located at the retraction position.

Further, the bulge protrudes out of the internal surface of the first side plate, and both the first fitting portion and the second fitting portion are fitting holes matching with the bulge.

Further, the bulge is a ball, and the fitting holes are circular holes matching with the ball.

Further, a locating slide way is provided between the first fitting portion and the second fitting portion, such that the bulge slides between the first fitting portion and the second fitting portion.

Further, the second clamping arm comprises a second clamping arm body and an abutting portion, a first end of the abutting portion is connected with one end, away from the connecting portion, of the second clamping arm body and tilts to the first clamping arm, and a second end of the abutting portion extends to a direction away from the first clamping arm and forms a free end.

Further, an internal surface of a first end of the second side plate is provided with a sliding groove, the sliding groove extends from the first end of the second side plate to a second end of the second side plate, and the first clamping arm is provided in the sliding groove.

According to some embodiments of the present disclosure, a knife is provided, which comprises a handle and a knife body. The handle is the foregoing handle, and the knife body is pivoted to one end, away from a handle clamp, of a handle body.

According to some embodiments of the present disclosure, when the handle clamp is located at the extension position (the connecting portion of the handle clamp is away from the handle body), the handle is hung in the pocket, and when the pocket well fits the handle, the handle clamp moves to the retraction position. At this time, the handle clamp fits the handle body, and the handle clamp is in a closed state (the connecting portion of the handle clamp is close to the handle body). The foregoing structure enables the handle clamp to fit the handle body to more steadily clamp the pocket. Some embodiments of the present disclosure effectively solve the problems in the prior art that a handle is prone to slide off from a pocket due to a bad fit between the handle and the pocket and the handle is not prone to be hidden in the pocket when the handle is clamped in the pocket.

BRIEF DESCRIPTION OF THE DRAWINGS

The drawings of the description, forming a part of the present disclosure, are intended to provide a further understanding for the present disclosure. The schematic embodiments and illustrations of the present disclosure are intended to explain the present disclosure, and do not form improper limits to the present disclosure. In the drawings.

Figure 1:
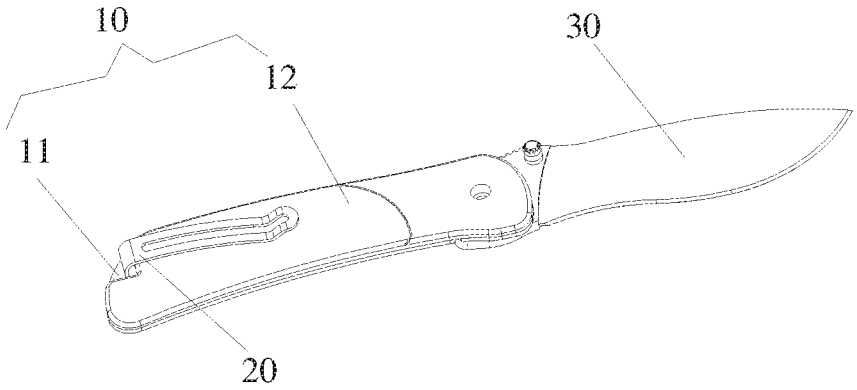
FIG. 1 shows a schematic diagram of a knife of which a handle clamp is located at a retraction position according to some embodiments of the present disclosure.

Wherein, the foregoing drawings include the following drawing marks:

10, handle body; 11, first side plate; 111, cantilever; 112, bulge; 12, second side plate; 121, sliding groove; 20, handle clamp; 21, first clamping arm; 211, first fitting portion; 212, second fitting portion; 22, second clamping arm; 221, second clamping arm body; 222, abutting portion; 23, connecting portion; and 30, knife body.

DETAILED DESCRIPTION

It is important to note that embodiments in the present disclosure and features in some embodiments may be combined mutually under the condition of no conflicts. The present disclosure will be illustrated hereinbelow with reference to the drawings and in conjunction with some embodiments in detail.

It should be pointed out that the following detailed descriptions are exemplary and intended to provide a further illustration for the present disclosure. Unless specified otherwise, all technical and scientific terms used herein include the same meanings as those usually understood by a person of ordinary skill in the art of the present disclosure.

For ease of description, spatial relative terms such as 'over', 'above', 'on an upper surface' and 'upper' may be used herein for describing a spatial position relation between a device or feature and other devices or features shown in the drawings. It will be appreciated that the spatial relative terms aim to include different orientations in usage or operation besides the orientations of the devices described in the drawings. For example, if the devices in the drawings are inverted, devices described as 'above other devices or structures' or 'over other devices or structures' will be located as 'below other devices or structures' or 'under other devices or structures'. Thus, an exemplar term 'above' may include two orientations namely 'above' and 'below'. The device may be located in other different modes (rotated by 90 degrees or located in other orientations), and spatial relative descriptions used herein are correspondingly explained.

Now, implementation modes according to the present disclosure will be described in more detail with reference to the drawings. However, these implementation modes may be implemented in various different forms and should not be interpreted as being limited to implementation modes elaborated herein. It will be appreciated that provision of these implementation modes is intended to make the present disclosure disclosed thoroughly and completely, and concepts of these implementation modes are conveyed to a person of ordinary skill in the art. In the drawings, in order to make it clear, the thickness of a layer and a region is increased, and identical devices are marked by using identical drawing marks. Therefore, description therefor will be omitted.

Figure 2:
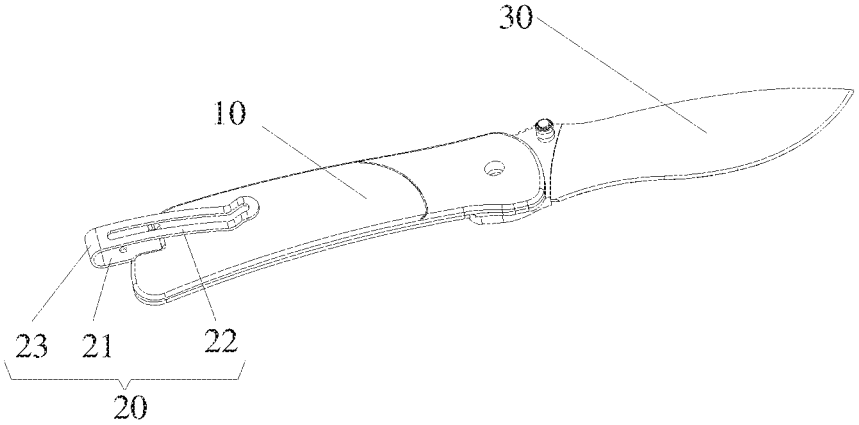
FIG. 2 shows a schematic diagram of a knife of which a handle clamp is located at an extension position in FIG. 1, according to some embodiments.

As shown in FIG. 1 and FIG. 2, a handle of the present embodiment comprises: a handle body 10 and a handle clamp 20. A locating portion is provided on the handle body 10. The handle clamp 20 comprises a first clamping arm 21, a second clamping arm 22 and a connecting portion 23, the connecting portion 23 is provided between the first clamping arm 21 and the second clamping arm 22, and the first clamping arm 21 is movably provided on the handle body 10 and enables the handle clamp 20 with a retraction position and an extension position.

According to some embodiments of the present embodiment, when the handle clamp 20 is located at the extension position (the connecting portion 23 of the handle clamp 20 is away from the handle body 10), the handle is hung in a pocket, and when the pocket well fits the handle, the handle clamp 20 moves to the retraction position. At this time, the handle clamp 20 matches with the handle body 10, and the handle clamp 20 is in a closed state (the connecting portion 23 of the handle clamp 20 is close to the handle body 10). On one hand, the foregoing structure enables the handle clamp 20 to fit the handle body 10 to more steadily clamp the pocket. On the other hand, the handle clamp 20 moves relative to the handle body 10, so the handle body 10 is not prone to be exposed from the pocket. Some embodiments of the present embodiment effectively solves the problems in the prior art that a handle is prone to slide off from a pocket due to a bad fit between the handle and the pocket and the handle is not prone to be hidden in the pocket when the handle is clamped in the pocket.

As shown in FIG. 1 to FIG. 4, in some embodiments of the present embodiment, a first fitting portion 211 and a second fitting portion 212 are provided on the first clamping arm 21, the first fitting portion 211 is close to the connecting portion 23 relative to the second fitting portion 212, when the first fitting portion 211 matches with the locating portion, the handle clamp 20 is located at the retraction position, and when the second fitting portion 212 fits the locating portion, the handle clamp 20 is located at the extension position. When the second fitting portion 212 of the first clamping arm 21 matches with the locating portion, the handle clamp 20 is located at the extension position (the connecting portion 23 of the handle clamp 20 is away from the handle body 10). At this time, the first fitting portion 211 on the first clamping arm 21 matches with the locating portion, the handle is hung in the pocket, and when the pocket well fits the handle, the handle clamp 20 moves to the retraction position. At this time, the first fitting portion 211 of the first clamping arm 21 matches with the locating portion, and the handle clamp 20 is in a closed state (the connecting portion 23 of the handle clamp 20 is close to the handle body 10). The foregoing structure is simple, and easy to set.

As shown in FIG. 1 to FIG. 4, in some embodiments of the present embodiment, the handle body 10 comprises a first side plate 11 and a second side plate 12, opposite to each other. The first side plate 11 is provided with an avoidance channel running through an internal surface of the first side plate 11 and an external surface of the first side plate 11, the locating portion is provided in the avoidance channel, the locating portion comprises a cantilever 111 and a bulge provided on the cantilever 111, and the bulge protruding inwardly, the first clamping arm 21 penetrates through the first side plate 11 and the second side plate 12, and the bulge 112 abuts against the first clamping arm 21. When some embodiments of the handle in the present embodiment is used, the second fitting portion 212 of the first clamping arm 21 matches with the locating portion, and the handle clamp 20 is located at the extension position (the connecting portion 23 of the handle clamp 20 is away from the handle body 10). At this time, the first fitting portion 211 on the first clamping arm 21 matches with the locating portion, the handle is hung in the pocket, and when the pocket well fits the handle, the handle clamp 20 moves to the retraction position. At this time, the first fitting portion 211 of the first clamping arm 21 matches with the locating portion, and the handle clamp 20 is in a closed state (the connecting portion 23 of the handle clamp 20 is close to the handle body 10). The foregoing structure enables the handle clamp 20 to more firmly fit the handle body 10.

Figure 3:
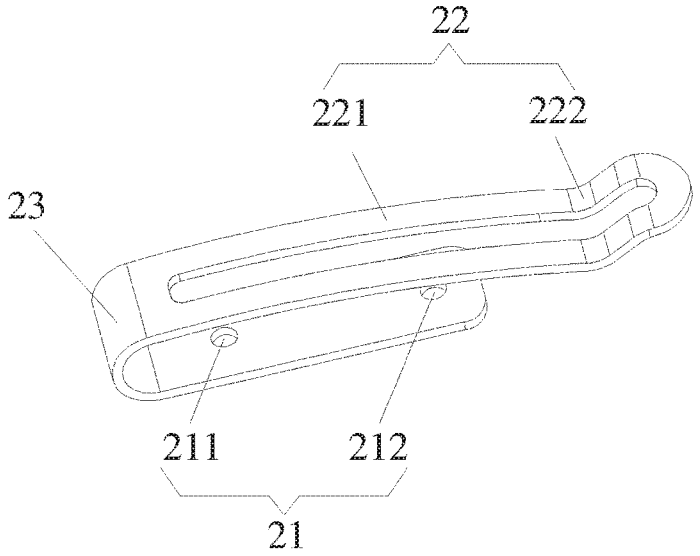
FIG. 3 is a structural diagram of a handle clamp of a knife in FIG. 1, according to some embodiments.
Figure 4:
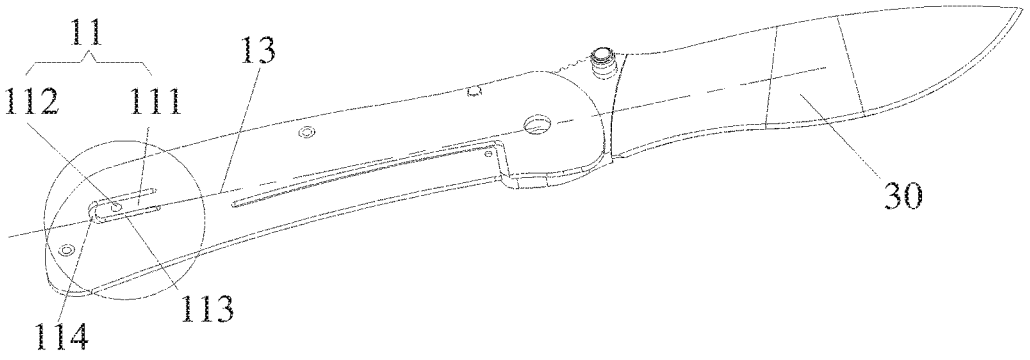
FIG. 4 is a structural diagram of a first side plate of a handle body of a knife in FIG. 1.
Figure 4A:
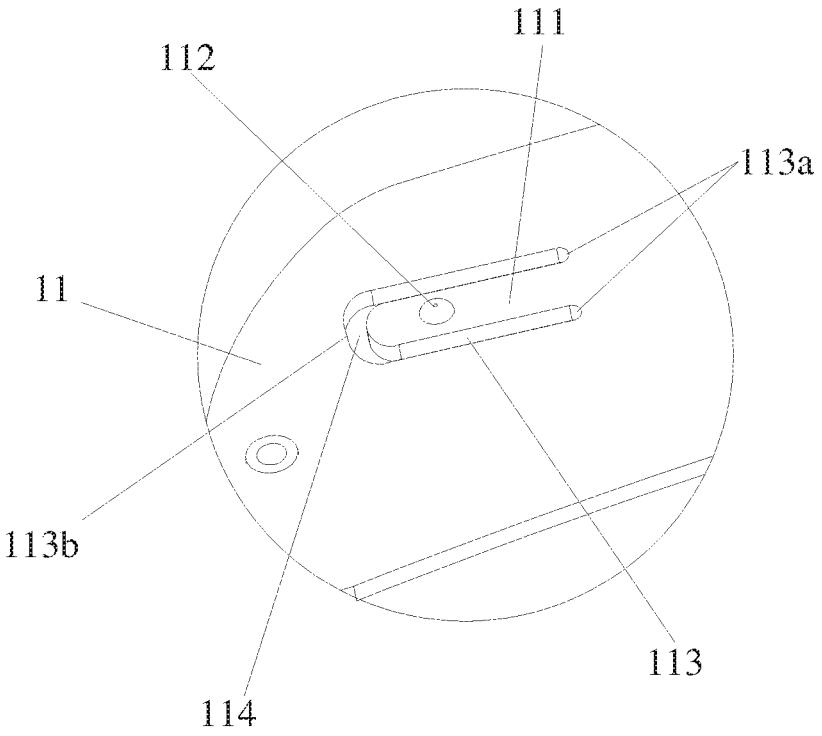
FIG. 4*a* is an enlarged view of a portion of the handle body of FIG. 4.

As shown in FIG. 3 and FIG. 4 (as well as in FIG. 4*a*), in the technical solution of the present embodiment, the avoidance channel is provided at a first end of the first side plate 11, a first end of the cantilever 111 is connected with an inner wall 113*a*, away from a first end of the first side plate 11, of the avoidance channel 114, and a clearance 113 is provided between a second end of the cantilever 111 and an inner wall 113*b*, close to the first end of the first side plate 11, of the avoidance channel.

Figure 5:
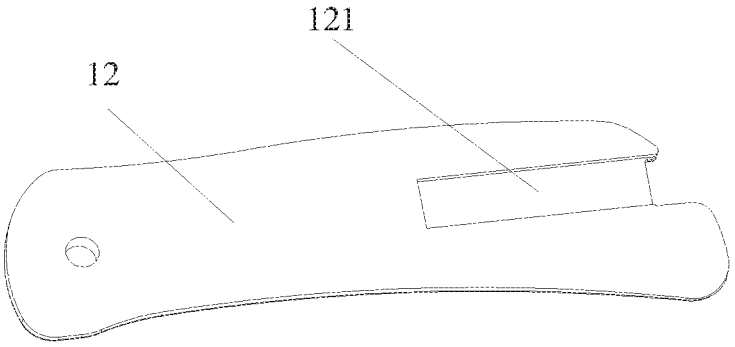
FIG. 5 is a structural diagram of a second side plate of a handle body of a knife in FIG. 1, according to some embodiments.

As shown in FIG. 1, FIG. 4 and FIG. 5, in the technical solution of the present embodiment, a first end of the second side plate 12 has an avoidance gap in order that the handle clamp 20 cannot protrude out of the first end of the first side plate 11 when the handle clamp 20 is located at the retraction position. The foregoing structure enables, on one hand, the first clamping arm 21 to be prone to move along a longitudinal axis 13 of the handle body 10 from the clearance such that the handle clamp 20 conveniently moves to the retraction position or moves to the extension position, and enables, on the other hand, the first clamping arm 21 to be easier to assemble and disassemble. Specifically, when the handle clamp 20 is located at the retraction position, the first end of the first side plate 11 is adaptive to an outer edge of the handle clamp 20 in contour (specifically, the connecting portion 23 remains horizontal). Such handle is attractive in appearance and forms an integral whole.

As shown in FIG. 3 and FIG. 4, in some embodiments of the present embodiment, the locating portion further comprises the bulge 112 arranged on the cantilever 111, the bulge 112 protrudes out of the internal surface of the first side plate 11, and both the first fitting portion 211 and the second fitting portion 212 are fitting holes fitting the bulge 112. On one hand, the foregoing structure is easy to process and manufacture. On the other hand, the foregoing structure enables the locating portion to easily fit the first fitting portion 211 and the second fitting portion 212. Specifically, when some embodiments of the handle in the present embodiment is used, the fitting hole of the first clamping arm 21 fits the bulge 112, so the handle clamp 20 is located at the extension position and the retraction position. Certainly, a person skilled in the art knows that there may be multiple fitting holes in an axial direction of the first clamping arm 21 as required. So, the handle clamp 20 may fit a plurality of positions of the handle body 10.

As shown in FIG. 4, in some embodiments of the present embodiment, the bulge 112 is a ball, which may specifically be a glass ball or a steel ball. The bulge is the glass ball in the present embodiment. The fitting holes are circular holes fitting the ball. The surface of the glass ball is relatively smooth, so a friction force between the glass ball and the handle body 10 as well as the first clamping arm 21 is small. The foregoing structure facilitates, on one hand, movement of the handle clamp between the extension position and the retraction position (small friction force, small exerted force), and achieves, on the other hand, a small friction between the glass ball and the handle body 10 as well as the first clamping arm 21 due to the small friction force. So, the service lives of the first clamping arm 21 and the handle body 10 may be prolonged.

In some embodiments of the present embodiment, a locating slide way is provided between the first fitting portion 211 and the second fitting portion 212, such that the bulge 112 slides between the first fitting portion 211 and the second fitting portion 212. Specifically, the cambered surface, width, etc. of the locating slide way are adaptive to those of the glass ball, thus effectively solving the problems of inaccurate locating of the handle clamp 20 in a movement process and easy deviation from a set position.

As shown in FIG. 1 to FIG. 3, the second clamping arm 22 comprises a second clamping arm body 221 and an abutting portion 222, a first end of the abutting portion 222 is connected with one end, away from the connecting portion 23, of the second clamping arm body 221 and tilts to the first clamping arm 21. Due to an abutting fit between the abutting portion 222 and the second side plate 12, a clamping force between the abutting portion 222 and the second side plate 12 is larger, and besides, a distance is provided between the second clamping arm body 221 and the second side plate 12, so a thicker clamped object can be accommodated between the second clamping arm body 221 and the second side plate 12. A second end of the abutting portion 222 extends to a direction away from the first clamping arm 21 and forms the free end. The foregoing structure enables a certain distance to be provided between the free end of the abutting portion 222 and the second side plate 12, so the clamped object is easy to enter a space between the second clamping arm 22 and the second side plate 12. Specifically, a hollowed structure is also provided in the middle of the second clamping arm 22. The foregoing structure achieves, on one hand, an attractive appearance, and enables, on the other hand, the handle to be light in weight. Certainly, a person skilled in the art knows that the hollowed structure on the second clamping arm 22 may be in multiple forms such as a patterned shape. In the present embodiment, an elongated hole structure from a first end of the second clamping arm 22 to the second end of a second clamping arm 22 is adopted.

As shown in FIG. 2 and FIG. 5, in some embodiments of the present embodiment, an external surface of the first end of the second side plate 12 is provided with a sliding groove 121, the sliding groove 121 extends from the first end of the second side plate 12 to a second end of the second side plate 12, and the first clamping arm 21 is provided in the sliding groove 121. The foregoing structure enables the first clamping arm 21 not to be prone to slide off from the sliding groove 121 of the second side plate 12 when the second clamping arm 22 moves from the extension position to the retraction position. So, the structure of the sliding groove 121 better achieves locating between the first clamping arm 21 and the second side plate 12.

The present disclosure also provides a knife. The knife according to some embodiments of the present disclosure comprises a handle and a knife body 30. The handle is the foregoing handle, and the knife body 30 is pivoted to one end, away from a handle clamp 20, of a handle body 10. Specifically, the knife in the present embodiment is a folding knife. When the knife is carried about, the knife body 30 is folded into the handle first, the handle clamp 20 then moves to an extension position, the folding knife is put into a pocket, an outer edge of the pocket is put between the handle clamp 20 and the handle body 10 and enters a space between a second clamping arm body 221 and a second side plate 12, and the handle clamp 20 moves to a retraction position finally. So, the folding knife can be firmly put into the pocket. If the folding knife is lifted by a hand, the handle clamp 20 may also move to the extension position, so a large clearance is provided between the handle clamp 20 and the handle body 10, thus making it convenient to lift the folding knife by the hand.

It is important to note that terms used herein only aim to describe a specific implementation mode and are not intended to limit an exemplar implementation mode of the present disclosure. For example, unless otherwise directed by the context, singular forms of terms used herein are also intended to include plural forms. Besides, it will be also appreciated that when terms 'comprise' and/or 'include' are used in the present description, it is pointed out that features, steps, operations, devices, assemblies and/or a combination thereof exist.

It is necessary to note that the description and claims of the present disclosure and terms 'first', 'second', etc. in the foregoing drawings are used for distinguishing similar objects rather than describing a specific sequence or a precedence order. It will be appreciated that the terms used in such a way may be exchanged under appropriate conditions, in order that the implementation mode of the present disclosure described here can be implemented in a sequence other than sequences graphically shown or described here. In addition, terms 'include' and 'have' and any inflexions thereof are intended to cover non-exclusive inclusions. For example, it is not limited for processes, methods, systems, products or devices including a series of steps or units to clearly list those steps or units, and other steps or units which are not clearly listed or are inherent to these processes, methods, products or devices may be included instead.

The above is only some embodiments of the present disclosure, and not intended to limit the present disclosure. As will occur to a person skilled in the art, the present disclosure is susceptible to various modifications and changes. Any modifications, equivalent replacements, improvements and the like made within the spirit and principle of the present disclosure shall fall within the scope of protection of the present disclosure. Also, the features and attributes of the specific embodiments disclosed above may be combined in different ways to form additional embodiments, all of which fall within the scope of the present disclosure. Although the present disclosure provides certain preferred embodiments and applications, other embodiments that are apparent to those of ordinary skill in the art, including embodiments which do not provide all of the features and advantages set forth herein, are also within the scope of this disclosure. Accordingly, the scope of the present disclosure is intended to be defined only by reference to the appended claims.

What is claimed is:

1. A handle, comprising:

a handle body, a locating portion is provided on the handle body; and a handle clamp, the handle clamp comprising a first clamping arm, a second clamping arm and a connecting portion, the connecting portion is provided between the first clamping arm and the second clamping arm, and the first clamping arm is movably provided on the handle body and enables the handle clamp to retract and extend between a retracted position and an extended position, wherein the first clamping arm is movable along a longitudinal axis of the handle body and transferrable between the retracted position and the extended position;

a first fitting portion and a second fitting portion are provided on the first clamping arm, the first fitting portion is closer to the connecting portion relative to the second fitting portion, when the first fitting portion matches with the locating portion, the handle clamp is located at the retracted position, and when the second fitting portion matches with the locating portion, the handle clamp is located at the extended position;

wherein the handle body comprises a first side plate and a second side plate, opposite to each other, the first side plate is provided with an avoidance channel running through an internal surface of the first side plate and an external surface of the first side plate, the locating portion is provided in the avoidance channel, the locating portion comprises a cantilever and a bulge provided on the cantilever, the bulge protruding inwardly, the first clamping arm penetrates through the first side plate and the second side plate, and the bulge abuts against the first clamping arm.

2. The handle as claimed in claim 1, wherein the avoidance channel is provided at a first end of the first side plate, a first end of the cantilever is connected with an inner wall, away from the first end of the first side plate, of the avoidance channel, and a clearance is provided between a second end of the cantilever and an inner wall, close to the first end of the first side plate, of the avoidance channel.

3. The handle as claimed in claim 2, wherein a first end of the second side plate has an avoidance gap in order that the handle clamp cannot protrude out of the first end of the first side plate when the handle clamp is located at the retracted position.

4. The handle as claimed in claim 1, wherein the bulge protrudes out of the internal surface of the first side plate, and both the first fitting portion and the second fitting portion are fitting holes matching with the bulge.

5. The handle as claimed in claim 4, wherein the bulge is a ball, and the fitting holes are circular holes matching with the ball.

6. The handle as claimed in claim 1, wherein a locating slide way is provided between the first fitting portion and the second fitting portion, such that the bulge slides between the first fitting portion and the second fitting portion.

7. The handle as claimed in claim 1, wherein the second clamping arm comprises a second clamping arm body and an abutting portion, a first end of the abutting portion is connected with one end, away from the connecting portion, of the second clamping arm body and tilts to the first clamping arm, and a second end of the abutting portion extends to a direction away from the first clamping arm and forms a free end.

8. The handle as claimed in claim 7, wherein an internal surface of a first end of the second side plate is provided with a sliding groove, and the first clamping arm is provided in the sliding groove.

9. A knife, comprising a handle and a knife body, wherein the handle is the handle as claimed in claim 1, and the knife body is pivoted to one end, away from the handle clamp, of the handle body.

10. The knife as claimed in claim 9, wherein the avoidance channel is provided at a first end of the first side plate, a first end of the cantilever is connected with an inner wall, away from the first end of the first side plate, of the avoidance channel, and a clearance is provided between a second end of the cantilever and an inner wall, close to the first end of the first side plate, of the avoidance channel.

11. The knife as claimed in claim 10, wherein a first end of the second side plate has an avoidance gap in order that the handle clamp cannot protrude out of the first end of the first side plate when the handle clamp is located at the retracted position.

12. The knife as claimed in claim 9, wherein the bulge protrudes out of the internal surface of the first side plate, and both the first fitting portion and the second fitting portion are fitting holes matching with the bulge.

13. The knife as claimed in claim 12, the bulge is a ball, and the fitting holes are circular holes matching with the ball.

14. The knife as claimed in claim 9, wherein a locating slide way is provided between the first fitting portion and the second fitting portion, such that the bulge slides between the first fitting portion and the second fitting portion.

15. The knife as claimed in claim 9, wherein the second clamping arm comprises a second clamping arm body and an abutting portion, a first end of the abutting portion is connected with one end, away from the connecting portion, of the second clamping arm body and tilts to the first clamping arm, and a second end of the abutting portion extends to a direction away from the first clamping arm and forms a free end.

16. The knife as claimed in claim 15, wherein an internal surface of a first end of the second side plate is provided with a sliding groove, and the first clamping arm is provided in the sliding groove.

* * * * *